US008331592B2

(12) United States Patent
Wu et al.

(10) Patent No.: US 8,331,592 B2
(45) Date of Patent: Dec. 11, 2012

(54) WIRELESS GATEWAY FOR HEARING AID

(75) Inventors: Fan Wu, Scottsdale, AZ (US); Samuel L. Thomasson, Gilbert, AZ (US)

(73) Assignee: Zounds Hearing, Inc., Phoenix, AZ (US)

( * ) Notice: Subject to any disclaimer, the term of this patent is extended or adjusted under 35 U.S.C. 154(b) by 712 days.

(21) Appl. No.: 12/231,182

(22) Filed: Aug. 29, 2008

(65) Prior Publication Data

US 2010/0054511 A1 Mar. 4, 2010

(51) Int. Cl.
*H04R 25/00* (2006.01)

(52) U.S. Cl. ..... 381/315

(58) Field of Classification Search ..... 381/315
See application file for complete search history.

(56) References Cited

U.S. PATENT DOCUMENTS 7,174,026 B2 2/2007 Niederdränk ..... 381/315
2009/0258672 A1* 10/2009 Camp et al. ..... 455/553.1

* cited by examiner

*Primary Examiner* — Jerome Jackson, Jr.
*Assistant Examiner* — Dale E Page
(74) *Attorney, Agent, or Firm* — Cahill Glazer PLC

(57) ABSTRACT

A remote control unit includes an RF transceiver that complies with a Bluetooth® standard and an RF transmitter that does not comply with the Bluetooth® standard, whereby the remote control unit serves as a wireless gateway between Bluetooth® compliant devices and the hearing aid. The hearing aid can further include a transmitter and the remote control unit can further include a receiver, neither of which comply with the Bluetooth® standard. The transmitters operate in the ISM band at low power, minimizing power dissipation within a hearing aid.

13 Claims, 2 Drawing Sheets

WIRELESS GATEWAY FOR HEARING AID

BACKGROUND

This invention relates to a hearing aid that can communicate with a plurality of external devices and, in particular, to a gateway between a hearing aid and a plurality of external devices.

It is known in the art to provide a hearing aid with a Bluetooth® interface for communicating with external devices; e.g. see U.S. Pat. No. 7,174,026 (Niederdränk).

Bluetooth® technology was named after the tenth century king, Harald "Bluetooth" (an Anglicized version of "Blaatand"), who united warring tribes, somewhat the way the Bluetooth® standard unifies different technologies. The standard has been reviewed and revised since its inception and continues to evolve without losing its basic focus.

Bluetooth® technology relates to a spread spectrum, radio frequency (RF) transmission in a globally unlicensed industrial, scientific, and medical (ISM) band at 2.4 GHz. There are three power levels or classes. Class 1 has a maximum power of 100 mW (milliwatts) and a range of approximately one hundred meters. Class 2 has a maximum power of 2.5 mW and a range of approximately ten meters. Class 3 has a maximum power of 1 mW and a range of approximately one meter. Most applications are Class 2. There is a group studying ultra low power Bluetooth® technology.

In the particular application of a hearing aid, power dissipation is a constant problem, particularly for in-the-ear type hearing aids. A small space dictates a small battery. If power dissipation is too great, battery life is reduced. Also, there is a limit on how much heat can be generated in the ear canal of a user without raising the temperature of the hearing aid to an uncomfortable level.

The '026 patent does not disclose power. The named possible signal sources (telephone, PC, television set, stereo system) imply a system that is Class 2 (2.5 mW). This figure is for the power into the final amplifier, sometimes considered the output power to an antenna. In either case, it is not the power for the whole system. A commercially available, Class 2, Bluetooth® module consumes 78 mW during audio streaming (reception). This is a large load for any hearing aid, particularly for an in-the-ear hearing aid.

In view of the foregoing, it is therefore an object of the invention to provide a communication interface or gateway for hearing aids.

Another object of the invention is to provide a low power level communication system for a hearing aid.

A further object is to provide Bluetooth® technology for a hearing aid without adding more than 20 mW to the load on the battery in the hearing aid.

SUMMARY OF THE INVENTION

The foregoing objects are achieved by this invention in which a remote control unit includes an RF transceiver that complies with a Bluetooth® standard and an RF transmitter that does not comply with the Bluetooth® standard, whereby the remote control unit serves as a wireless gateway between Bluetooth® compliant devices and the hearing aid. The hearing aid can further include a transmitter and the remote control unit can further include a receiver, neither of which comply with the Bluetooth® standard. The transmitters operate in the ISM band at low power, minimizing power dissipation within a hearing aid.

BRIEF DESCRIPTION OF THE DRAWINGS

A more complete understanding of the invention can be obtained by considering the following detailed description in conjunction with the accompanying drawings, in which.

DETAILED DESCRIPTION OF THE INVENTION

Figure 1:
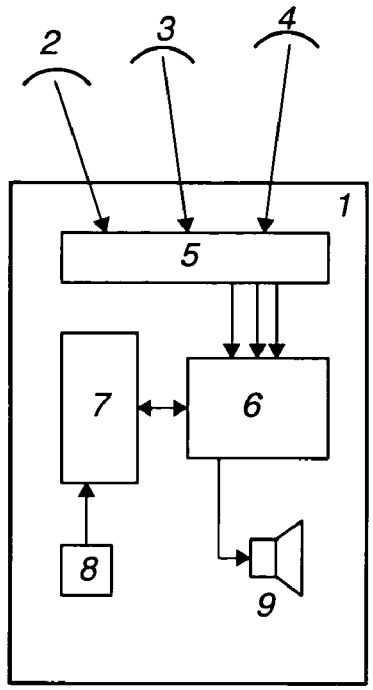
FIG. 1 (PRIOR ART)
FIG. 1 is block diagram taken from U.S. Pat. No. 7,174,026.

The description of FIG. 1 is quoted from the '026 patent.

FIG. 1 "shows a block diagram of a hearing aid 1 that receives radio signals from a plurality of transmitters or signal sources 2, 3, 4. A radio receiver, which preferably contains a bluetooth interface 5, registers all radio signals and forwards them to a converter 6."

"The address of possible transmitters or signal sources 2, 3, 4 are stored in an address register or memory 7 and respectively provided with a priority. The addresses and/or priorities can be input into the hearing aid using an input unit 8."

"Based on the priority from the address register 7, the converter 6 decides which of the signals sent from the signal sources 2, 3, 4 must be converted into an acoustic signal for an output unit 9 in the hearing aid 1. Over and above this, a manual selection of the signal source can be alternatively or additionally provided, for example via a push-button."

Figure 2:
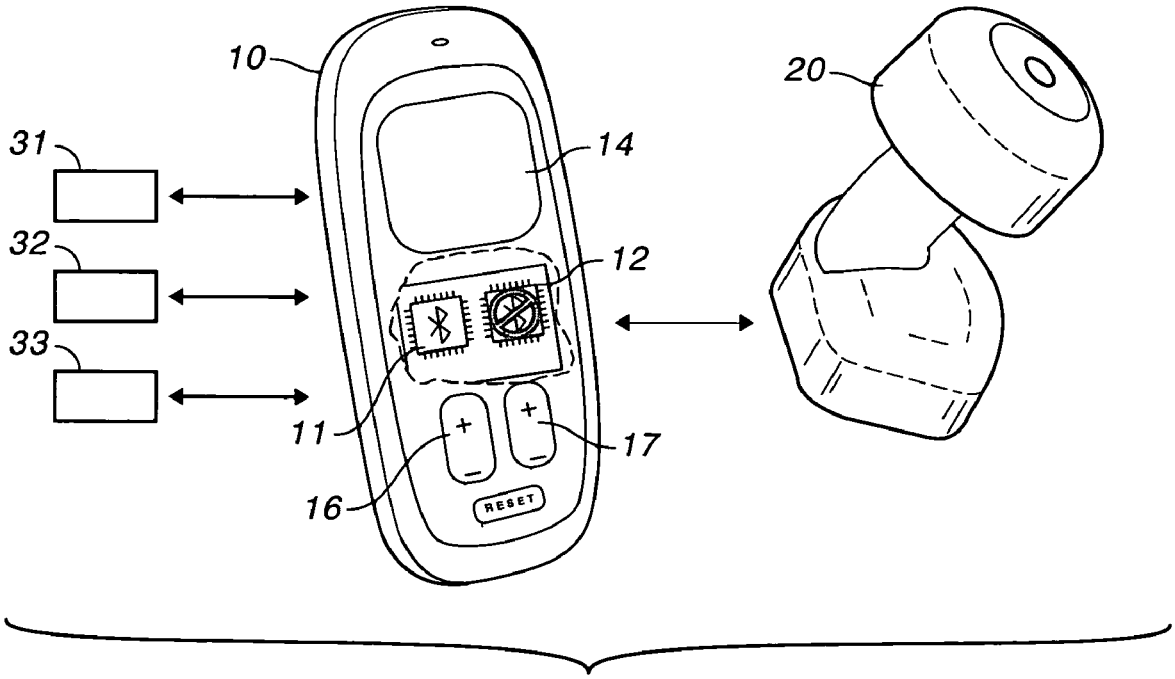
FIG. 2 illustrates a wireless gateway constructed in accordance with a preferred embodiment of the invention.

In accordance with the invention, as illustrated in FIG. 2, remote control unit 10 acts as a gateway between hearing aid 20 and a plurality of Bluetooth® devices, 31, 32, and 33. Such devices include iPods, microphones, telephones, hand held game players, computers, and televisions. These devices communicate with remote control unit 10 by way of first transceiver 11, a Bluetooth® connection. Remote control unit 10, in turn, communicates with hearing aid 20 by means of second transceiver 12, a non-Bluetooth® connection.

In a preferred embodiment of the invention, the second transceiver is preferably an ultra-high frequency transceiver, also operating in the ISM band. A suitable device is a type nRF24L01 transceiver from Nordic Semiconductor. Hearing aid 20 is also equipped with a type nRF24L01 transceiver. These devices consume very little power and have programmable output power levels of 1 mW, 398 μW, 63 μW, or 16 μW. Each transceiver is preferably coupled to a ShockBurst™ codec, also available from Nordic Semiconductor. Addressing capabilities of the codec permit a single remote control unit to control plural hearing aids independently.

In this embodiment, the complete radio transmission system in hearing aid 20, including microcontroller, codec, and transceiver dissipates 14 mW during audio streaming. This is a significant improvement over the 78 mW consumed by a Bluetooth® module. Further, the nRF24L01 transceiver consumes approximately 2 μW in standby or power down mode.

Obviously, remote control unit 10 includes Bluetooth transceiver 11 but the 78 mW power consumption is not a problem because of the much larger volume of the unit, particularly for batteries. Thus, remote control unit 10 can communicate with devices 31, 32, and 33 at relatively high power level and with hearing aid 20 at relatively low power, below 20 mW total power consumption. Device selection is controlled by screen 14, which can also be a touch screen, and a keypad including buttons 16 and 17. The control can be automatic, i.e. programmed, or manual.

Figure 3:
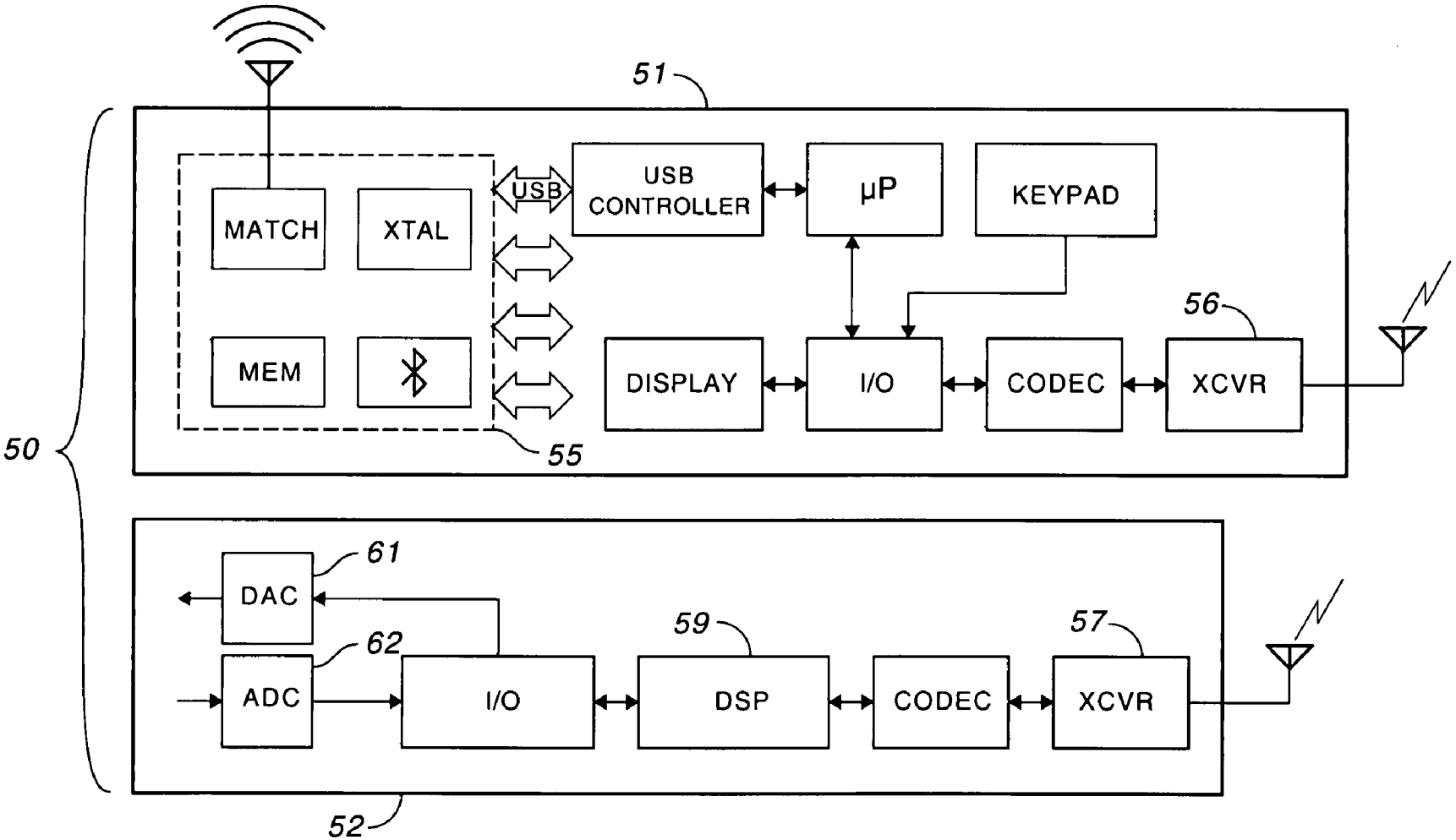
FIG. 3 is a detailed block diagram of a wireless gateway constructed in accordance with a preferred embodiment of the invention.

As illustrated in FIG. 3, a preferred embodiment of hearing aid system 50 includes remote control unit 51 and at least one hearing aid, represented by hearing aid 52. Remote control unit 51 contains two transceivers, Bluetooth® transceiver 55 and non-Bluetooth transceiver 56. In one embodiment of the invention, transceiver 55 is a type APM8282 Bluetooth® module available from apm Communications, Inc. of Taiwan. Transceivers 56 and 57 are each a type nRF24L01 module.

Audio signals selected by Bluetooth® transceiver 55 in remote control unit 51 are coupled to transceiver 56 and transmitted to hearing aid 51. Hearing aid 52 processes the signals in DSP device 59 to accommodate the particular hearing loss of the user and sends the signals to digital to analog converter (DAC) 61. The output from DAC 61 is coupled to one or more suitable speakers (not shown), also known as "receivers."

Acoustic signals are converted into electrical signals by one or more microphones (not shown) and coupled to analog to digital converter 62, processed in DSP device 59, and coupled to DAC 61. The converted signals can be transmitted to remote control unit 51 for transmission to an external Bluetooth® device, e.g. for system diagnostics or hearing evaluation.

The invention thus provides a gateway for coupling a hearing aid to devices observing the Bluetooth® protocol, without causing excessive power dissipation in the hearing aid and without requiring a Bluetooth® module in the hearing aid. Power consumption by the communication portion of a hearing aid is minimized yet communication with Bluetooth® devices is possible.

Having thus described the invention, it will be apparent to those of skill in the art that various modifications can be made within the scope of the invention. For example, the invention is compatible with any type of hearing aid, from behind-the-ear to completely-in-the-canal.

What is claimed as the invention is:

1. A hearing aid system comprising in combination:

a) a hearing aid adapted to be placed about a user's ear for amplifying audio signals, the hearing aid including:
   i. an electrical power source; and
   ii. an RF receiver for receiving radio frequency signals containing audio signals, the RF receiver requiring less than 20 milliwatts of electrical power from the electrical power source of the hearing aid; and b) a remote control unit for communicating with the hearing aid, the remote control unit including:
   i. an electrical power source;
   ii. a first RF receiver for receiving RF source signals from at least one RF source device, the RF source signals containing audio signals to be amplified by the hearing aid, the first RF receiver of the remote control unit requiring more than 20 milliwatts of power from the electrical power source of the remote control unit; and
   iii. a first RF transmitter for sending radio frequency signals to the RF receiver of the hearing aid, the radio frequency signals sent by the first RF transmitter of the remote control unit including audio signals contained in the RF source signals.

2. A hearing aid system as recited by claim 1 wherein the first RF receiver within the remote control unit receives RF source signals within a first range of frequencies, and wherein the RF receiver of the hearing aid receives radio frequency signals having a frequency higher than the first range of frequencies.

3. A hearing aid system as recited by claim 2 wherein the first RF receiver within the remote control unit receives RF source signals compatible with Bluetooth® communication standards.

4. A hearing aid system as recited by claim 3 wherein the RF receiver of the hearing aid receives radio frequency signals in the ISM band.

5. A hearing aid system as recited by claim 1 wherein:

a) the hearing aid system includes at least a second hearing aid;
b) the remote control unit includes a codec for addressing more than one hearing aid; and
c) each hearing aid includes a codec for detecting that such hearing aid is being addressed by the remote control unit.

6. A hearing aid system as recited by claim 1 wherein:

a) the hearing aid includes an RF transmitter for sending for sending radio frequency signals from the hearing aid to the remote control unit, the RF transmitter of the hearing aid requiring less than 20 milliwatts of electrical power from the electrical power source of the hearing aid; and
b) the remote control unit includes a second RF receiver for receiving radio frequency signals sent by the RF transmitter of the hearing aid.

7. A hearing aid system as recited by claim 6 wherein the second RF receiver of the remote control unit requires less than 20 milliwatts of electrical power from the electrical power source of the remote control unit.

8. A hearing aid system as recited by claim 7 wherein:

a) the first RF receiver within the remote control unit receives RF source signals within a first range of frequencies;
b) the RF receiver of the hearing aid receives radio frequency signals having a frequency higher than the first range of frequencies;
c) the RF transmitter of the hearing aid transmits radio frequency signals having a frequency higher than the first range of frequencies; and
d) the second RF receiver of the remote control unit receives radio frequency signals having a frequency higher than the first range of frequencies.

9. A hearing aid system as recited by claim 8 wherein the first RF receiver within the remote control unit receives RF source signals compatible with Bluetooth® communication standards.

10. A hearing aid system as recited by claim 9 wherein the RF receiver of the hearing aid, and the RF transmitter of the hearing aid, operate in the ISM band.

11. A hearing aid system as recited by claim 9 wherein the RF receiver of the hearing aid, and the RF transmitter of the hearing aid, are not compatible with Bluetooth® communication standards.

12. A hearing aid system as recited by claim 9 wherein the first RF receiver within the remote control unit receives RF source signals compatible with Bluetooth® communication standards.

13. A hearing aid system as recited by claim 12 wherein the RF receiver of the hearing aid receives radio frequency signals in the ISM band.

* * * * *